US008360261B2

(12) United States Patent
Eason et al.

(10) Patent No.: US 8,360,261 B2
(45) Date of Patent: Jan. 29, 2013

(54) FOLDABLE CONCRETE WASHOUT AND WASTE CONTAINMENT UNIT

(75) Inventors: Robert W. Eason, Boise, ID (US); Gregory D. Ramp, Boise, ID (US)

(73) Assignee: Outpak, Inc., Boise, ID (US)

( * ) Notice: Subject to any disclaimer, the term of this patent is extended or adjusted under 35 U.S.C. 154(b) by 246 days.

(21) Appl. No.: 12/968,217

(22) Filed: Dec. 14, 2010

(65) Prior Publication Data

US 2011/0139791 A1 Jun. 16, 2011

Related U.S. Application Data

(60) Provisional application No. 61/286,074, filed on Dec. 14, 2009.

(51) Int. Cl.
*B65D 5/60* (2006.01)

(52) U.S. Cl. ..... 220/495.06; 220/9.4; 220/666; 220/62

(58) Field of Classification Search ..... 220/9.4, 220/495.11, 495.08, 495.06, 6, 62, 1.6, 666; 229/113, 117.01, 117.05, 122.21
See application file for complete search history.

(56) References Cited

U.S. PATENT DOCUMENTS

| | | | | | |
|---|---|---|---|---|---|
| 1,700,758 | A | * | 2/1929 | Berkowitz | 229/117.05 |
| 2,048,205 | A | * | 7/1936 | Towell | 229/102.5 |
| 2,646,915 | A | | 7/1953 | Bockmann | |
| 3,476,304 | A | | 11/1969 | Asman | |
| 3,476,305 | A | | 11/1969 | Asman | |
| 3,638,852 | A | * | 2/1972 | Solanka | 229/117.01 |
| 4,341,338 | A | * | 7/1982 | Arnold | 229/122.21 |
| 5,062,527 | A | * | 11/1991 | Westerman | 229/117 |
| 5,542,541 | A | | 8/1996 | Smith | |
| 6,253,993 | B1 | * | 7/2001 | Lloyd et al. | 229/117.3 |
| 2006/0222270 | A1 | | 10/2006 | Modena | |

* cited by examiner

*Primary Examiner* — Stephen Castellano
(74) *Attorney, Agent, or Firm* — Charles R. Clark

(57) ABSTRACT

A foldable concrete washout and waste containment unit having a foldable support box receiving and supporting a flexible liner for receiving and retaining within the flexible liner within the support box waste materials.

2 Claims, 15 Drawing Sheets

FOLDABLE CONCRETE WASHOUT AND WASTE CONTAINMENT UNIT

CROSS-REFERENCE TO RELATED APPLICATIONS

This application claims benefit of 61/286,074 filed Dec. 14, 2009.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

In modern society, efforts are ongoing to prevent or lessen undesirable environmental impacts resulting from discharge of contaminants into the environment. On construction job sites, steps are being taken to lessen or eliminate environmental contamination resulting from uncontrolled discharge into the environment of waste contaminants such as concrete slurry, concrete sediment, concrete equipment washout effluents; waste paint and solvents; waste stucco mixtures; waste mortar mix; and other construction waste materials resulting from the construction processes.

Various portable concrete washout inventions and systems have been developed as tools in the ongoing efforts by society to contain liquids and other flowable materials.

The present invention is a foldable concrete washout and waste containment unit having a support box having a folding bottom floor and folding sides that depend upward from the floor and constructed from a substantially rigid stock sheet material: paper, paperboard, corrugated cardboard, fiberboard, corrugated plastic sheet material, or other suitable sheet material of appropriate weight.

An object of the present invention is to provide an inexpensive, disposable and easily deployable and retrievable waste containment unit having a novel open-topped generally rectangular-based support box and having a flexible liner or flexible bag disposed within and supported by the support box. After use at a location involving the receiving and holding of waste materials, the present waste containment unit is intended to be movable with the received and retained waste materials to an appropriate disposal location.

When used for waste concrete materials and concrete washout effluents, the waste within the waste containment unit often may consolidate and cure into a solid slab that can be moved for disposal by a user using a fork lift truck by placing the forks of the truck under the floor of the unit and lifting for subsequent movement of the unit to a disposal location or for placement into a suitably sized trash dumpster or into or onto some other disposal conveyance or receptacle.

In a preferred embodiment, the waste containment unit is made from two flat, die-cut, pre-scored half unit blanks, each blank having a generally rectangular central floor and an integral isosceles trapezoidal endwall contiguous to the floor along one edge of the floor and the endwall sandwiched between two integral opposite trapezoidal sidewalls, each sidewall respectively contiguous to the floor along opposite edges of the floor and each sidewall attached to the adjacent endwall, and the floor having an open floor edge opposite to the endwall; and the blanks aligned with respective floors coplanar and aligned with respective open floor edges facing adjacent one another and each sidewall of one blank attached to an adjacent sidewall of the other blank; and a flexible liner is disposed into and retained within the joined blanks that comprise the support box.

In the preferred embodiment, the waste containment unit is a generally square-based truncated four-sided pyramid shaped open top container having four interior corners, the open top container having an upper inner perimeter opening and two sidewalls and two endwalls inwardly sloped from towards the floor to the upper inner perimeter opening.

Another object of the present invention is to provide a waste containment unit that is more convenient and easier to use than prior art waste containment units.

The present invention relates to a novel concrete washout and waste containment invention comprising a support box having a folding floor, folding sidewalls, and folding endwalls that provides a useful portable waste containment unit that can be transported to a job site or other place for use in a compact, closed condition and once there articulated to an open condition to receive and contain waste materials, and that helps protect against release of the liquids and chemicals and other waste materials into the environment.

BRIEF SUMMARY OF THE INVENTION

A principal objective of this invention is to provide a concrete washout and waste containment unit invention having a support box having a folding floor and folding sidewalls that is easily articulated from a closed (folded) condition to an deployed (unfolded) condition; that can be selectively maintained in the deployed condition; that selectively can receive within and support a flexible liner; and that allows selective and convenient disposal of the liner and/or the waste containment unit after use. The invention is a novel concrete washout and waste containment invention comprising a support box having a folding floor that helps lessen the likelihood of environmental contamination by liquids and chemicals and waste materials received and retained within the control waste containment unit for subsequent movement and disposal along with the undergirding disposable waste containment unit.

Preferably, the flexible liner is a flexible polyethylene open-topped bag sized to fit within and be retained within the support box of the waste containment unit.

In an alternative embodiment, the liner may also be made from flexible polyethylene sheet material, coated fabric material, coated paper material, or some other suitable flexible impervious material.

A further object of the invention is making available to users a concrete washout and waste containment unit that is durable, easy to use, easy to secure in position, is inexpensive to manufacture, and is easy to deploy, use, and after use, is convenient to remove for disposal or storage.

Additional and various other objects and advantages attained by the invention will become more apparent as the specification is read and the accompanying figures are reviewed.

DETAILED DESCRIPTION OF THE INVENTION

The invention comprises a foldable concrete washout and waste containment unit having an open-topped support box that can be selectively switched by a user between a deployed (open) condition and a closed (storage) condition by manipulation and folding of the support box along a plurality of fold lines and having at least one flexible liner 4 (a flexible impervious bag) disposed within the support box.

Figure 1:
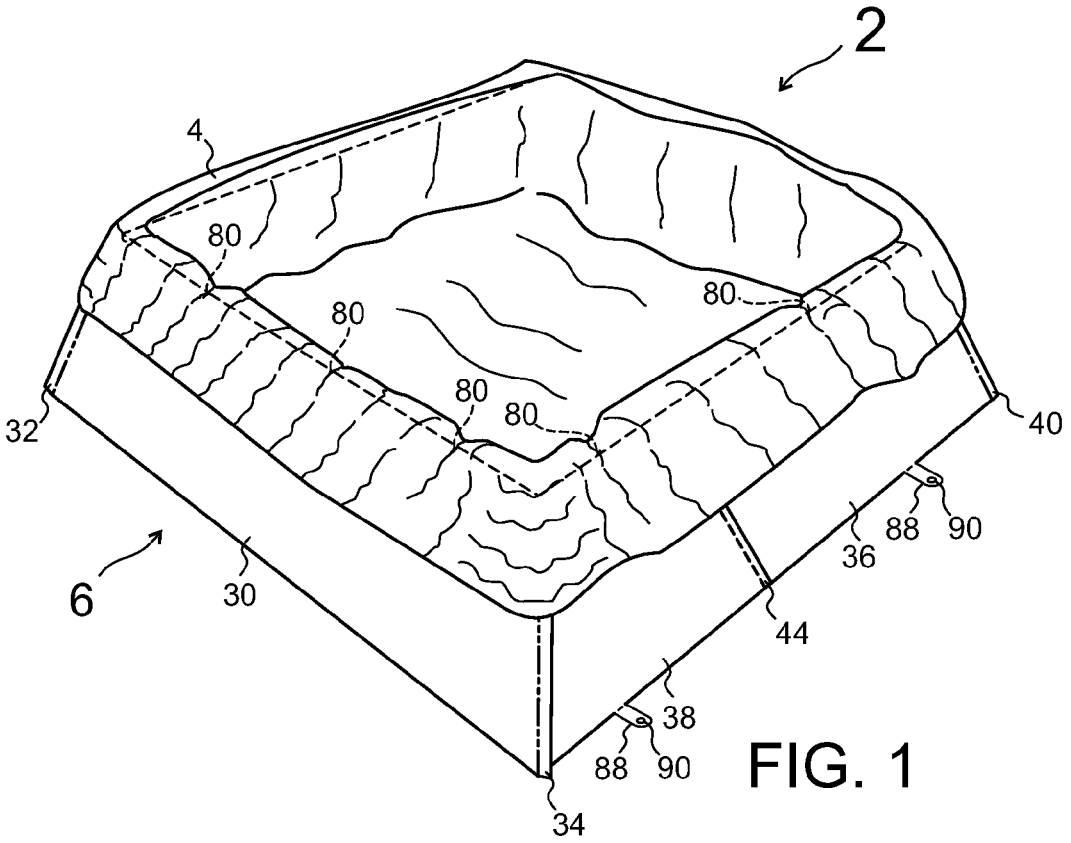
FIG. 1 is a perspective view of a preferred embodiment of a foldable concrete washout and waste containment unit 2 and showing a flexible liner 4 disposed and supported within a support box 6.
Figure 2:
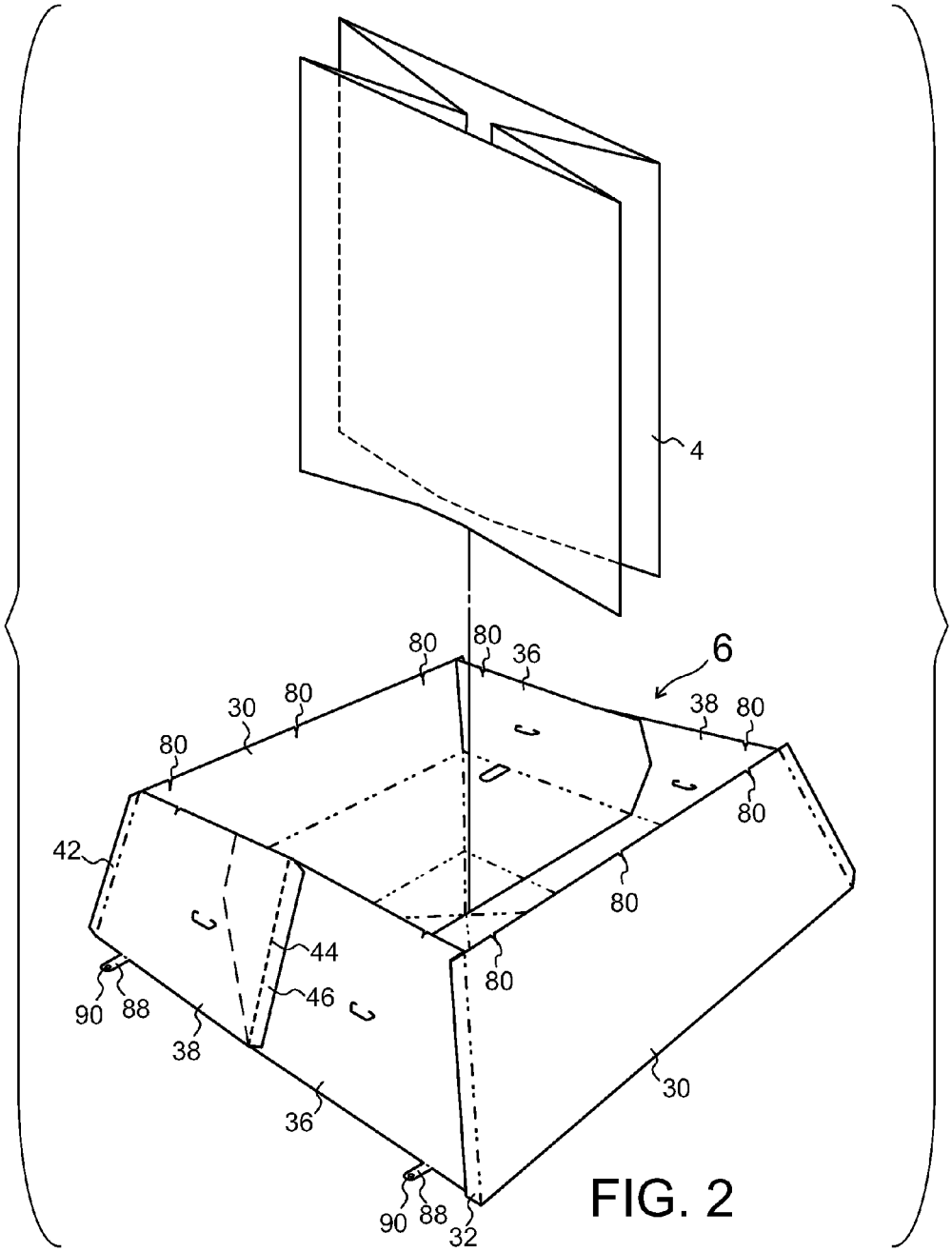
FIG. 2 is a partially exploded perspective view of a support box 6 and a flexible liner 4 about to be inserted into the box.
Figure 3:
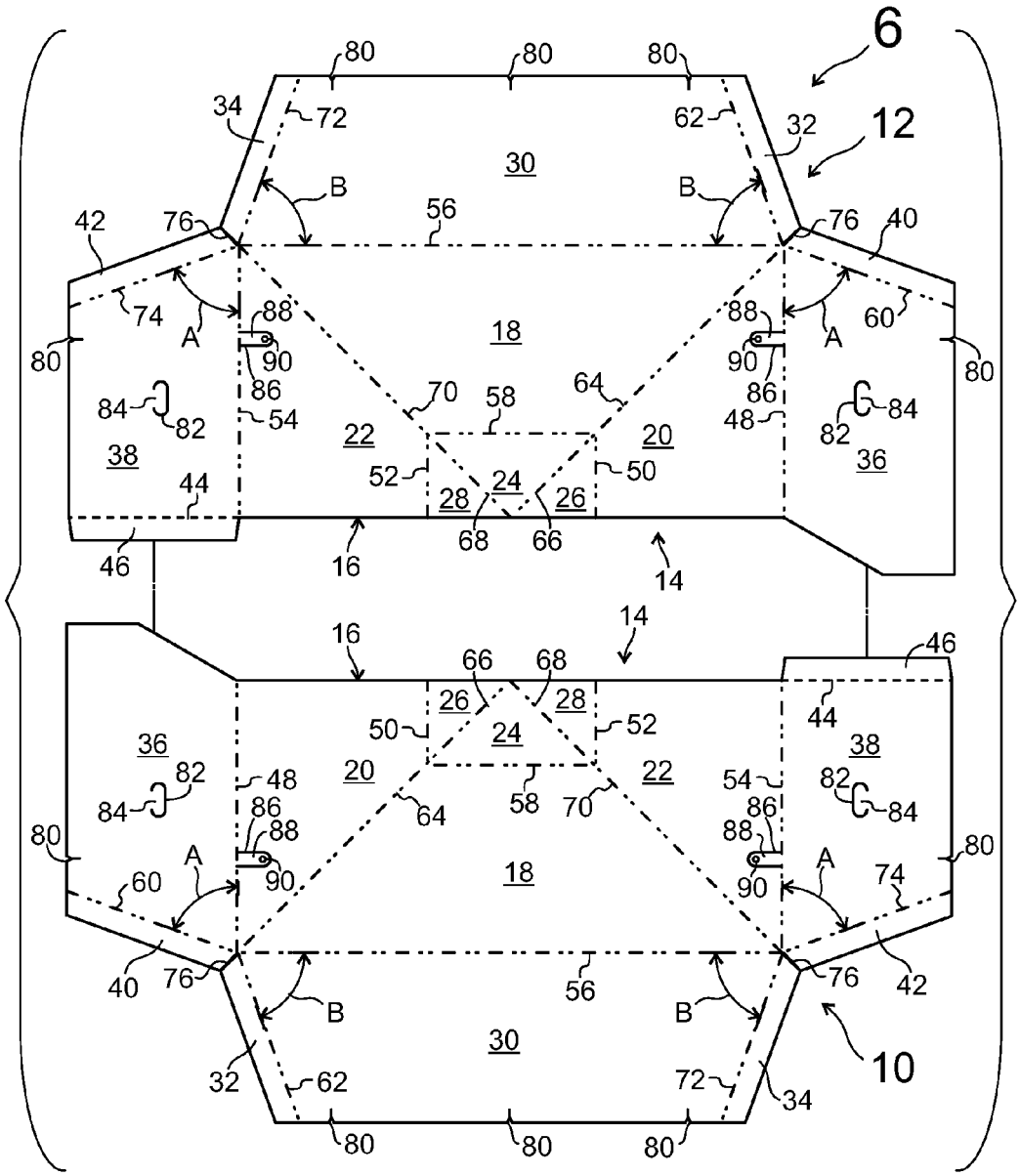
FIG. 3 is an exploded top plan view of the support box 6 shown in FIG. 2 comprising two flat, die-cut, and pre-scored support box blanks 10 and 12.
Figure 4:
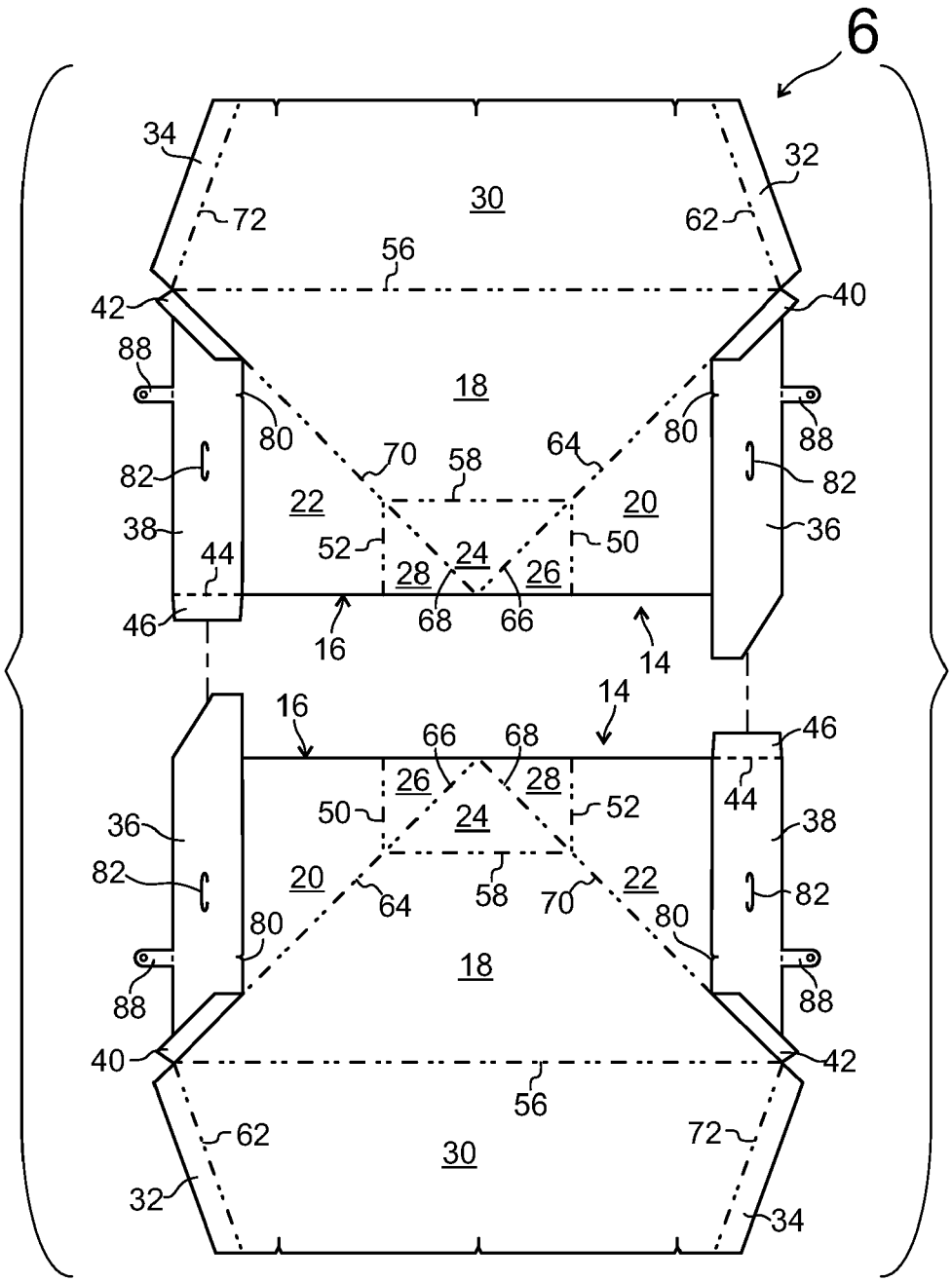
FIG. 4 is an exploded top plan view of the support box 6 shown in FIG. 3 partially assembled.
Figure 5:
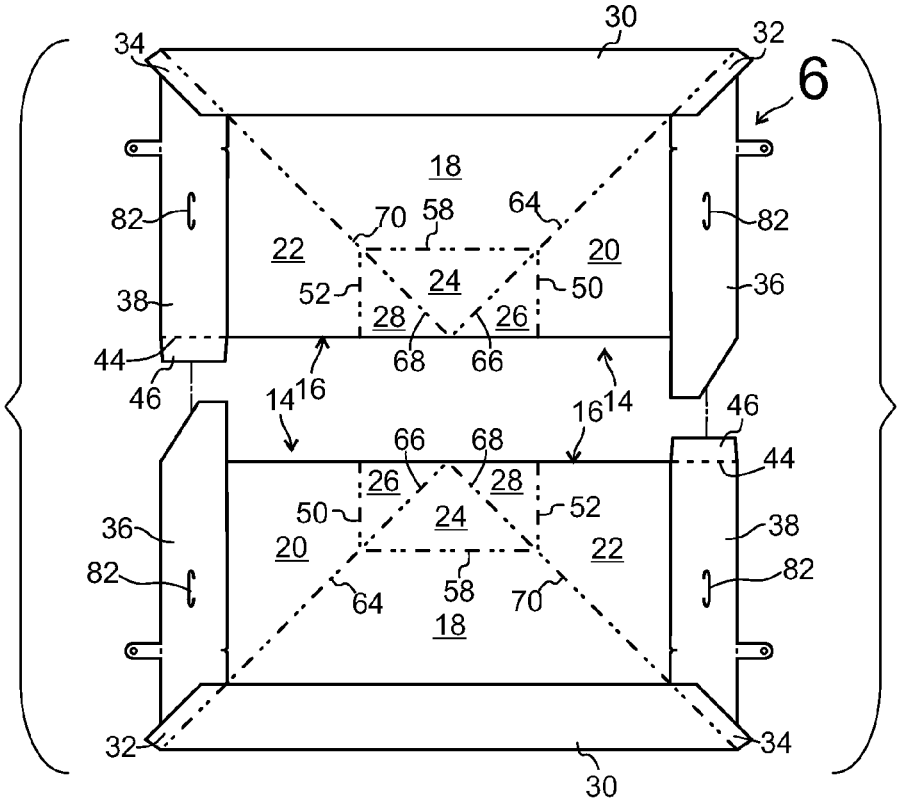
FIG. 5 is an exploded top plan view of the support box 6 shown in FIG. 4 further showing two end walls 30 raised and each end wall connected respectively to two adjacent sidewalls 36, 38.
Figure 6:
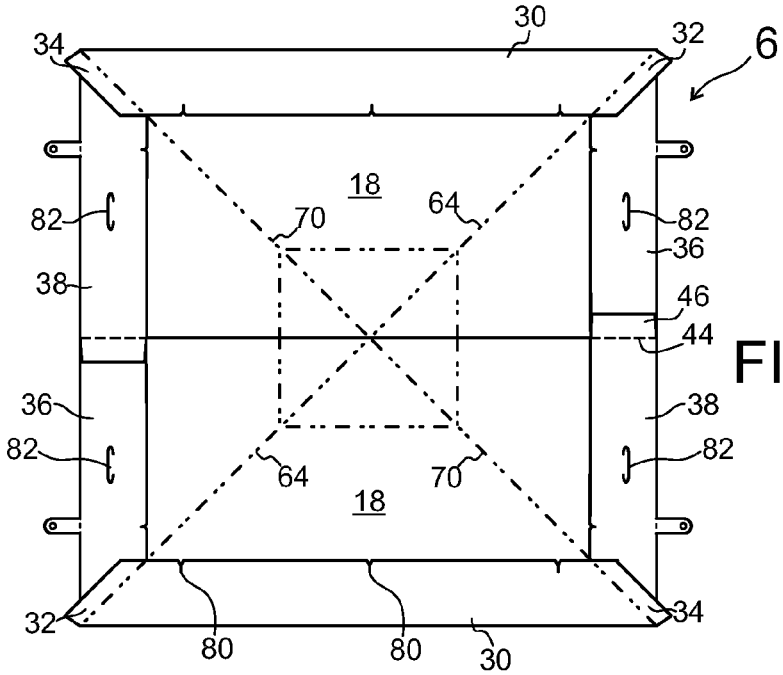
FIG. 6 is an top plan view of the support box 6 shown in FIG. 5 fully assembled in an open (deployed) condition.
Figure 7:
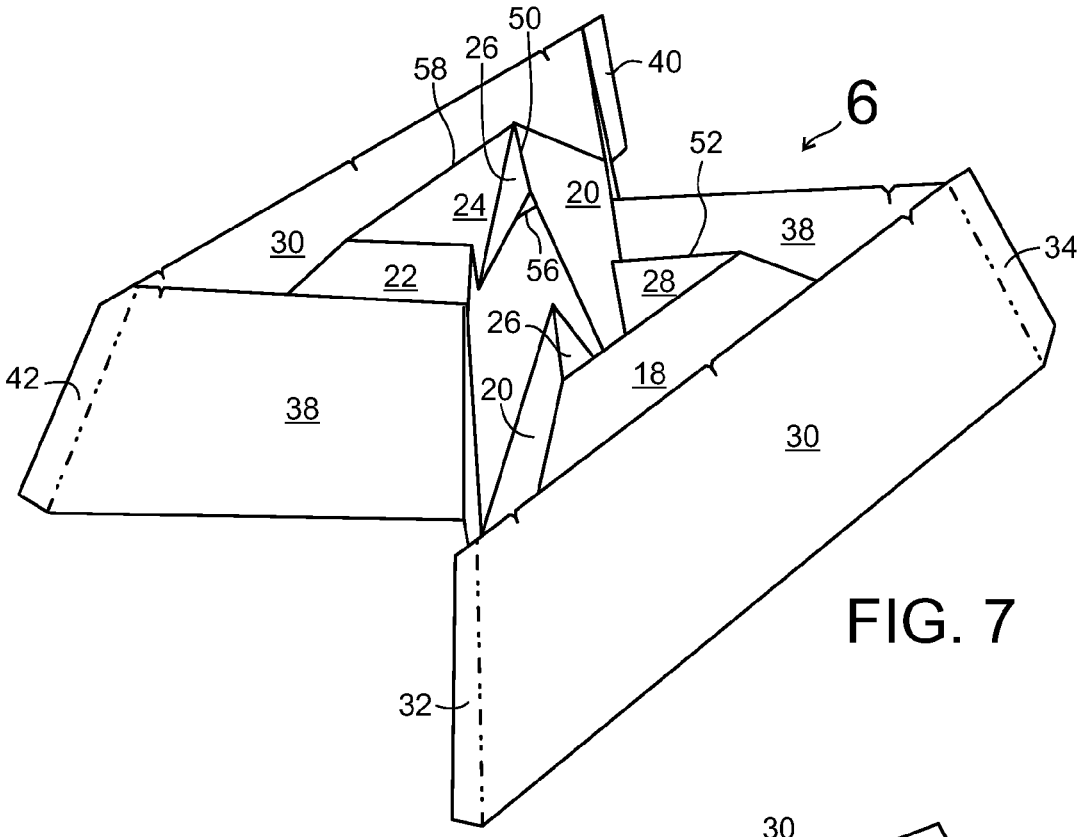
FIG. 7 is a perspective view of the support box 6 shown in FIG. 6 partially folded (articulated) from the open condition towards a closed condition.
Figure 8:
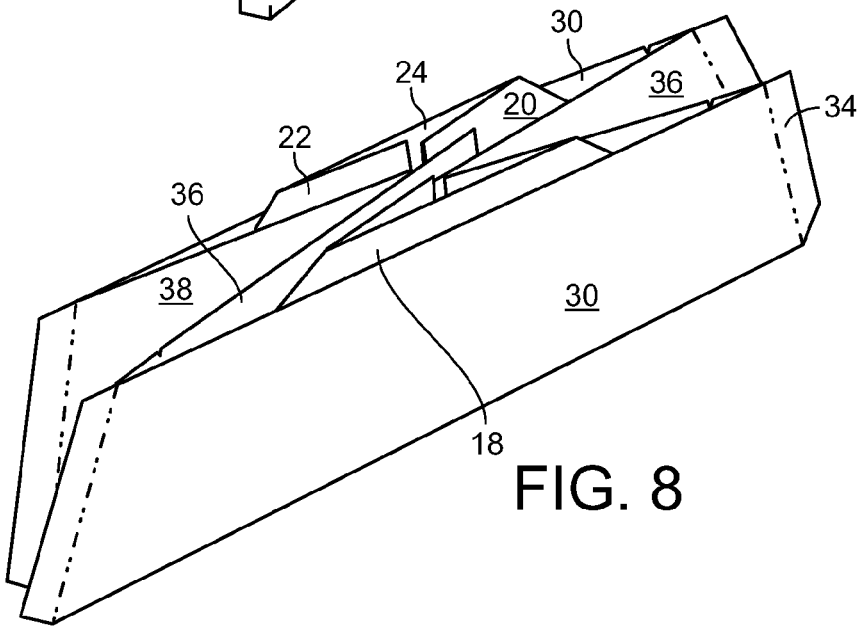
FIG. 8 is a perspective view of the support box 6 shown in FIG. 7 in a near fully folded, closed condition.

As shown in FIGS. 1 to 8, a preferred embodiment of the invention 2 comprises a generally truncated four-sided pyramidal support box 6 that is assembled and folded from two half unit blanks 10 and 12 shown in FIG. 3 which blanks are joined to one another, as shown in FIGS. 4, 5, and 6, and after assembly of the support box, the support box receives a liner 4 disposed into the support box to receive and contain waste materials. Blanks 10 and 12 are preferably each cut from a single piece of paper, paperboard, corrugated paperboard, corrugated plastic board or other suitable material of appropriate weight.

When referring to the plan views of the blanks, the usual drawing conventions for boxes fabricated from paper, paperboard, corrugated cardboard, or corrugated plastic board are applied. Unless otherwise noted, broken lines on the interior of a blank indicate scores or fold lines or other lines of weakness such as perforations; and solid lines within the interior of or extending to the edge of the blank indicate through cuts separating one portion of the blank from an adjacent portion of the blank.

In the preferred embodiment, see FIGS. 1 to 8, a concrete washout and waste containment unit 2 comprises a flexible liner 4 supported by a support box 6, the support box is preferably formed from two congruent support box blanks 10, 12 as shown in plan form (from an "inside" view) in FIG. 3 that are joined together; each support box blank having a rectangular floor 14; the floor defined by a floor free edge 16 along one edge of the floor and by three floor-to-wall fold lines 48, 56, and 54 along the other three floor edges; the floor having six interconnected floor panels including a full-floor length isosceles trapezoidal panel 18 having base angles of 45 degrees, two half trapezoidal panels 20, 22, each half trapezoidal panel having base angles of 45 and 90 degrees with the 45 degree base angle and associated leg of each half trapezoidal panel respectively adjacent to one of the base angles and along the length of one of the legs of the isosceles trapezoidal panel and with the other leg of each half trapezoidal panel associated with the 90 degree base angle being an end portion of the floor free edge, one larger isosceles right triangular panel 24 having a hypotenuse congruent and along the length of a smaller base of the isosceles trapezoidal panel, two congruent smaller isosceles right triangular panels 26, 28 with each smaller isosceles right triangular panel respectively having a hypotenuse congruent and along the length of one of the legs of the larger isosceles triangular panel and a leg congruent and along the length of a smaller base of one of the half trapezoidal panels and the other leg being one of two intermediate portions of the floor free edge; an integral endwall 30 depending upwards from and along the length of a larger base of the isosceles trapezoidal panel; two endwall corner overlap tabs 32, 34 with one endwall corner overlap tab at each end of the endwall; two integral half sidewalls 36, 38 with each sidewall respectively depending upwards from and along and extending beyond the length of a larger base of the adjacent half trapezoidal panel; two sidewall corner overlap tabs 40, 42 with respectively one sidewall corner overlap tab adjacent each endwall corner overlap tab; a sidewall hinge line 44 across one of the sidewalls 38 adjacent the floor free edge and perpendicular to the larger base of the adjacent half trapezoidal panel 22; a sidewall hinging overlap 46 extending across and beyond the hinge line from a main portion of the sidewall; fold lines 48, 50, 52, 54, 56, 58, 60, 62, 64, 66, 68, 70, 72, 74; die cuts 76, 82, 86; a plurality of liner gripping slits 80 distributed along the free edges of the endwalls and the sidewalls (preferably adjacent portions of the flexible liner 4 inserted into the support box are inserted into respective gripping slits to be retained therein by frictional forces whereby the liner is secured and retained within the support box); a plurality of handhold flaps 84 selectively distributed in the sidewalls; a plurality of floor anchor flaps 88 selectively distributed along the floor adjacent the sidewalls; and a plurality of anchor flap apertures 90 in the anchor flaps.

The support box 6 of the preferred embodiment is formed from two congruent flat, die-cut, pre-scored half unit blanks 10 and 12; the blanks are oriented to be coplanar and to have the floor free edge 16 of blank 10 adjacent and facing along the length of the floor free edge 16 of blank 12, to have the sidewall joining overlap 46 of each blank overlapping and joined by joining means to a cooperating portion of the sidewall 36 of the other blank.

Joining means may include radio frequency welding, heat fusing, ultrasonic welding, gluing with an adhesive, stitching, stapling, zip ties, rivets (plastic or metal) or another suitable method of joining known in the art may be used. Joining means preferably would be stapling with staples.

The liner 4 can be made from a polyethylene sheet material or made from a suitable flexible material such as a fabric or woven web made of polyester, nylon, or polypropylene yarn or polyethylene strands or other suitable yarn, each fabric or web is each coated with a selected coating such as a polyvinyl chloride coating, a polyurethane coating, a polypropylene coating, a polyethylene coating, or some other coating material that will remain impervious to the transmission of contamination through the coated fabric or coated web or the liner can be made from a suitable coated paper stock or from some other suitable sheet material.

FIG. 3 shows angle A between floor-to-wall fold line 48 and corner overlap tab fold line 60; and between floor-to-wall fold line 54 and corner overlap tab fold line 74. FIG. 3 shows angle B between floor-to-wall fold line 56 and endwall corner overlap tab fold line 62; and between floor-to-wall fold line 56 and endwall corner overlap tab fold line 72. Preferably in each embodiment of the invention, angles A and B will be congruent and be selectively chosen from a range between 50 and 130 degrees. The angle of A and B in FIG. 3 is approximately 67.5 degrees and the open condition of the support box 6 is a truncated four sided pyramidal shape sloping up and inward from the base of floor of the box.

Figure 9:
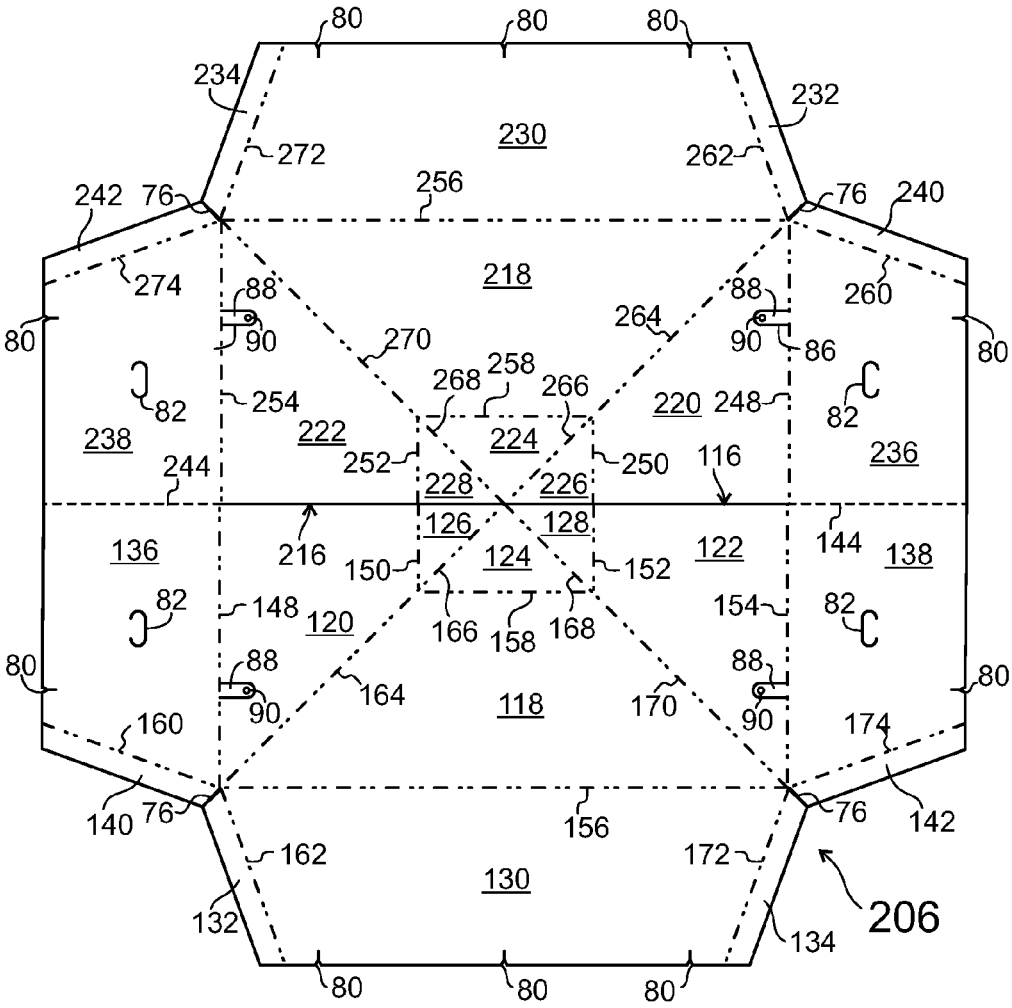
FIG. 9 is a top plan view of an alternative embodiment of an unassembled support box 206 having one flat, die-cut, and pre-scored support box blank.

FIG. 9 is a top plan view of an alternative embodiment of an unassembled support box 206 having only one flat, die-cut, and pre-scored support box blank. The alternative support box 206 is formed from a single flat, generally square, die-cut, and pre-scored support box blank as shown in plan form (from an "inside" view) in FIG. 9; the support box blank having two rectangular floors; each floor defined respectively by a floor free edge 116, 216 along one edge of each floor and by three floor-to-wall fold lines 148, 248, 156, 256, and 154, 254 along the other three edges; each floor respectively having six interconnected floor panels including a full-floor length isosceles trapezoidal panel 118, 218 having base angles of 45 degrees, two half trapezoidal panels 120, 122 and 220, 222, each half trapezoidal panel having base angles of 45 and 90 degrees with the 45 degree base angle and associated leg of each half trapezoidal panel respectively adjacent to one of the base angles and along the length of one of the legs of the isosceles trapezoidal panel and with the other leg of each half trapezoidal panel associated with the 90 degree base angle being an end portion of the floor free edge, one larger isosceles right triangular panel 124, 224 having a hypotenuse congruent and along the length of a smaller base of the isosceles trapezoidal panel, two congruent smaller isosceles right triangular panels 126, 128 and 226, 228 with each smaller isosceles right triangular panel respectively having a hypotenuse congruent and along the length of one of the legs of the larger isosceles triangular panel and a leg congruent and along the length of a smaller base of one of the half trapezoidal panels and the other leg being one of two intermediate portions of the floor free edge; an integral endwall 130, 230 depending upwards from and along the length of a larger base of the isosceles trapezoidal panel; two endwall corner overlap tabs 132, 134 and 232, 234 with one endwall corner overlap tab at each end of each endwall; two integral half sidewalls 136, 138 and 236, 238 with each sidewall respectively depending upwards from and along and extending beyond the length of a larger base of the adjacent half trapezoidal panel; two sidewall corner overlap tabs 140, 142 and 240, 242 with respectively one sidewall corner overlap tab adjacent each endwall corner overlap tab; a sidewall hinge line 144, 244, each sidewall hinge line respectively across one of the sidewalls 138, 238 adjacent each floor free edge and perpendicular to the larger base of the adjacent half trapezoidal panel 122, 222; fold lines 148, 150, 152, 154, 156, 158, 160, 162, 164, 166, 168, 170, 172, 174, 248, 250, 252, 254, 256, 258, 260, 262, 264, 266, 268, 270, 272, 274; die cuts 76, 82, 86; a plurality of liner gripping slits 80 distributed along the free edges of the endwalls and the sidewalls (preferably adjacent portions of the flexible liner 4 inserted into the support box are inserted into respective cooperating gripping slits to be retained therein by frictional forces whereby the liner is secured and retained within the support box); a plurality of handhold flaps 84 selectively distributed in the sidewalls; a plurality of floor anchor flaps 88 selectively distributed along the floor adjacent the sidewalls; and a plurality of anchor flap apertures 90 in the anchor flaps.

The folding of support box 206 follows substantially the same methodology as the folding of support box 6. The elements of support box 206 are the same as support box 6 with a deletion of the two sidewall hinging overlap 46 of support box 6 and the associated joining of two blanks of support box 6 between adjacent sidewalls. The assembled support box 206 is substantially equivalent to support box 6.

Figure 10:
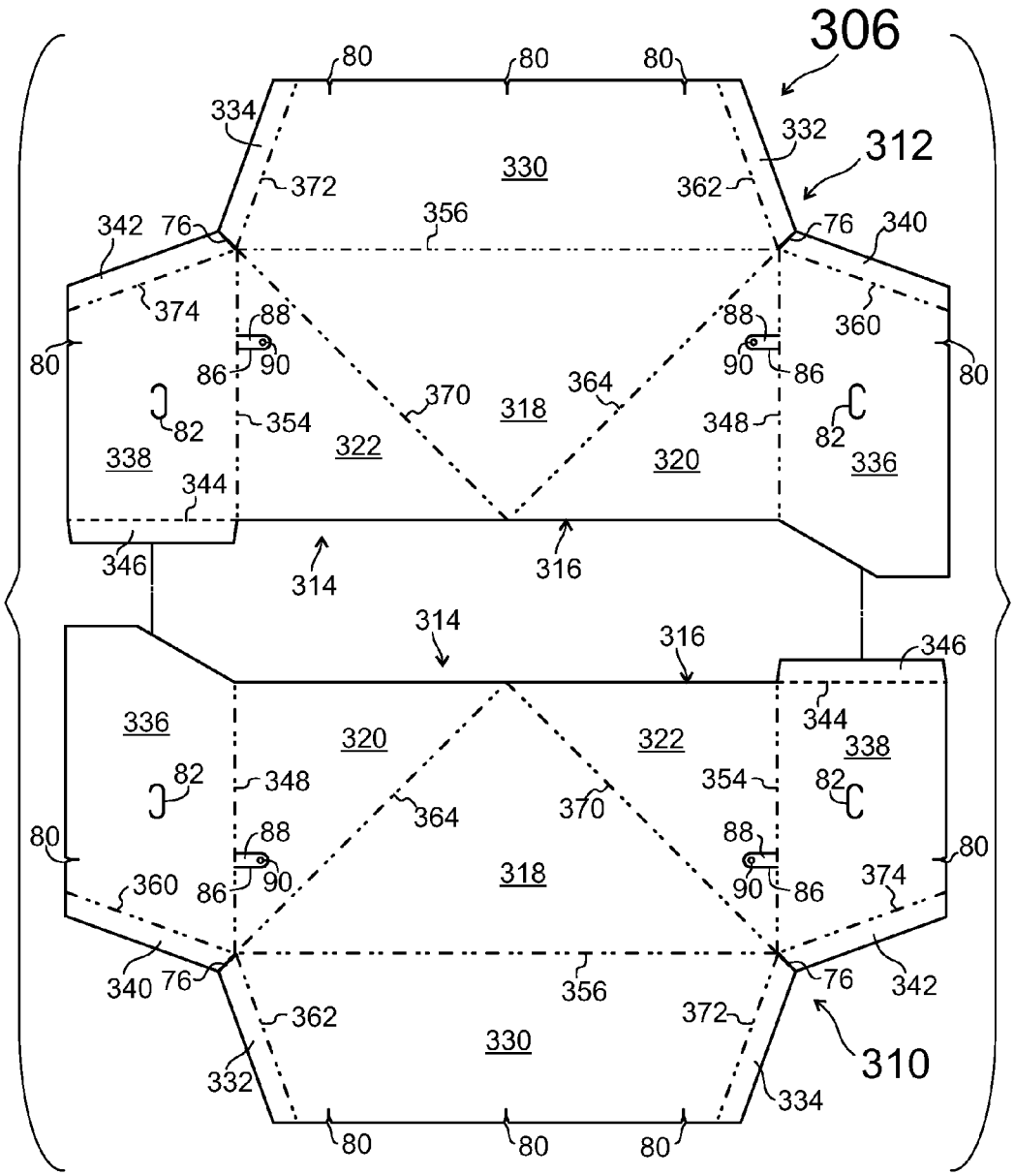
FIG. 10 is an exploded top plan view of a third alternative embodiment of a support box 306 comprising two flat, die-cut, and pre-scored support box blanks 310, 312.
Figure 11:
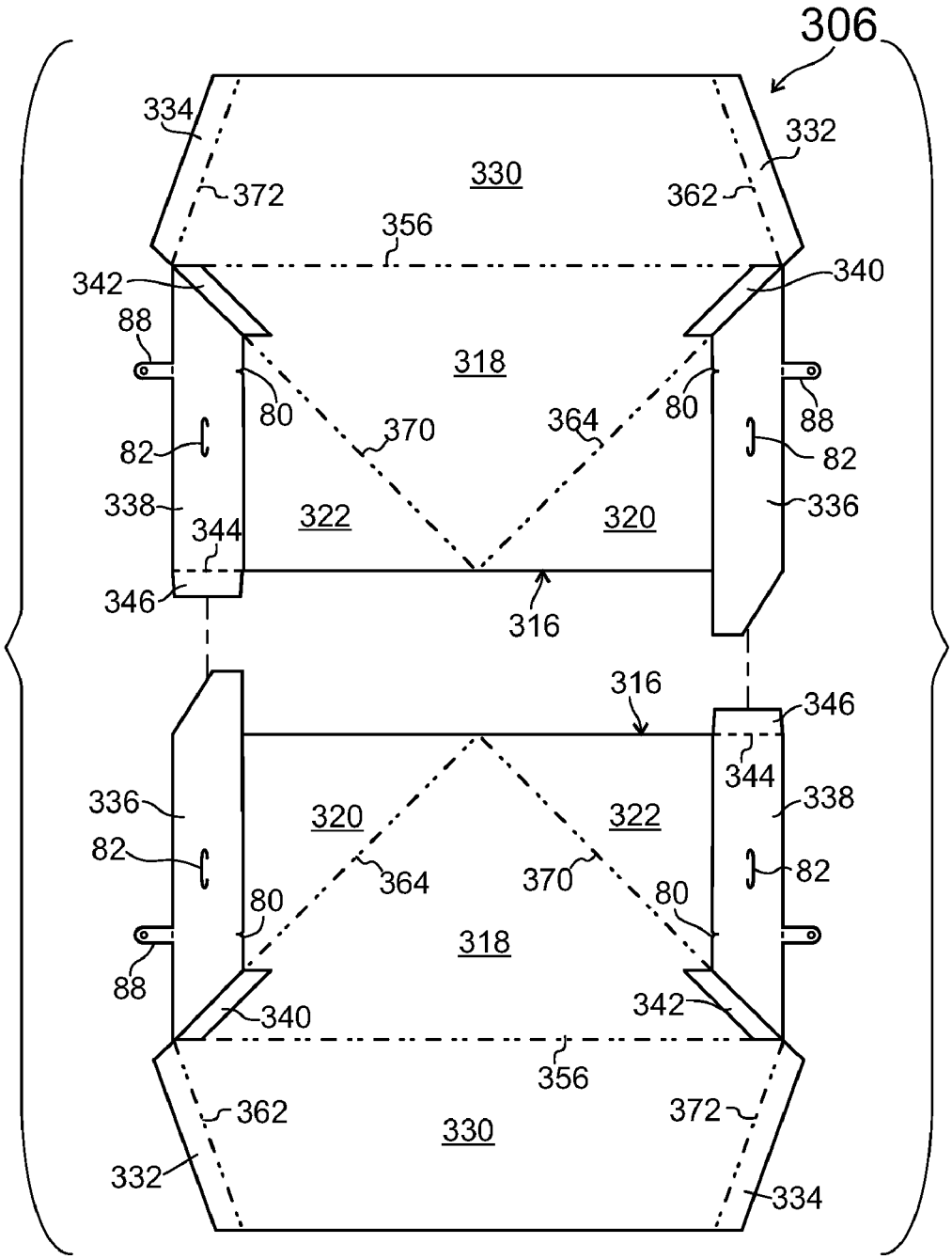
FIG. 11 is an exploded top plan view of the support box 306 shown in FIG. 10 partially assembled.
Figure 12:
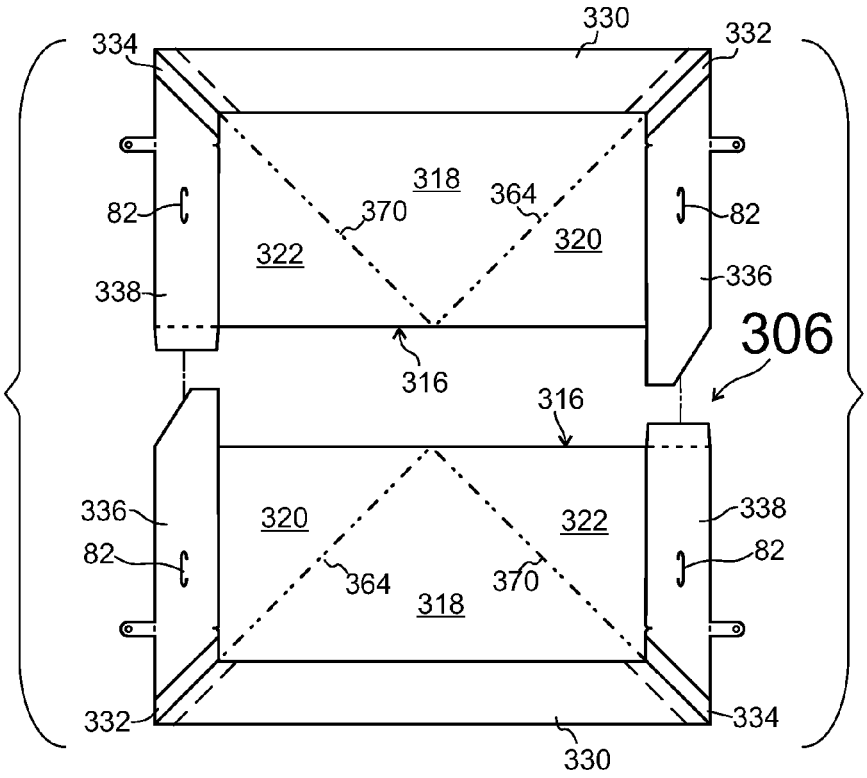
FIG. 12 is an exploded top plan view of the support box 306 shown in FIG. 11 further showing two end walls 330 raised and each end wall connected respectively to two adjacent sidewalls 336, 338.
Figure 13:
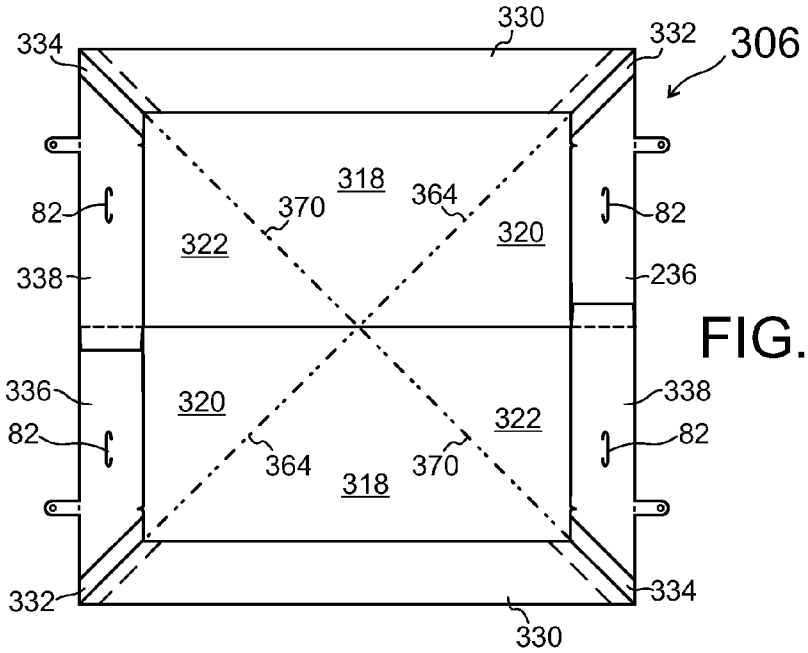
FIG. 13 is a top plan view of the support box 306 shown in FIG. 12 fully assembled in an open (deployed) condition.
Figure 14:
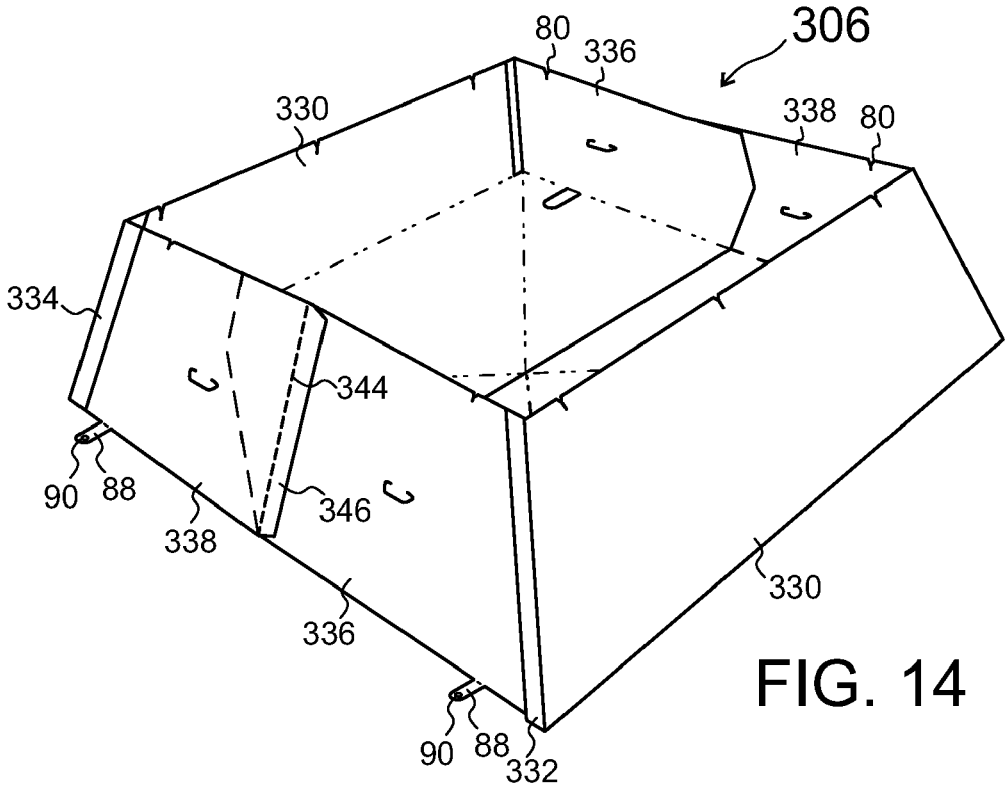
FIG. 14 is a perspective view of the support box 306 shown in FIG. 13.
Figure 15:
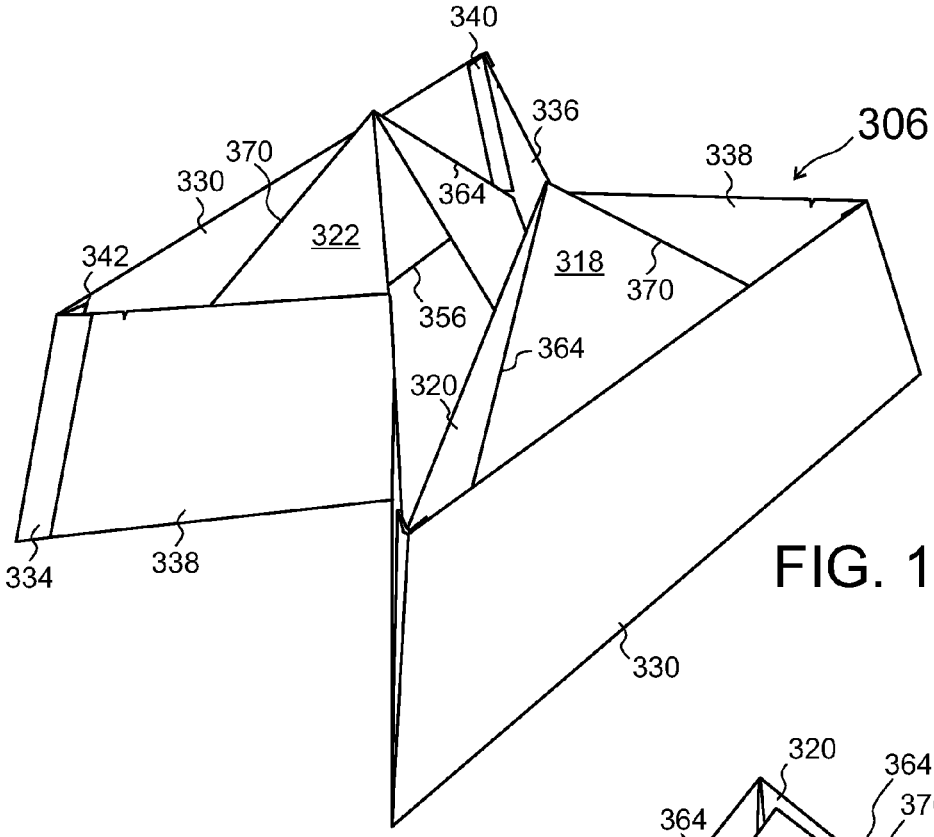
FIG. 15 is a perspective view of the support box 306 shown in FIG. 14 partially folded (articulated) from the open condition towards a closed condition.
Figure 16:
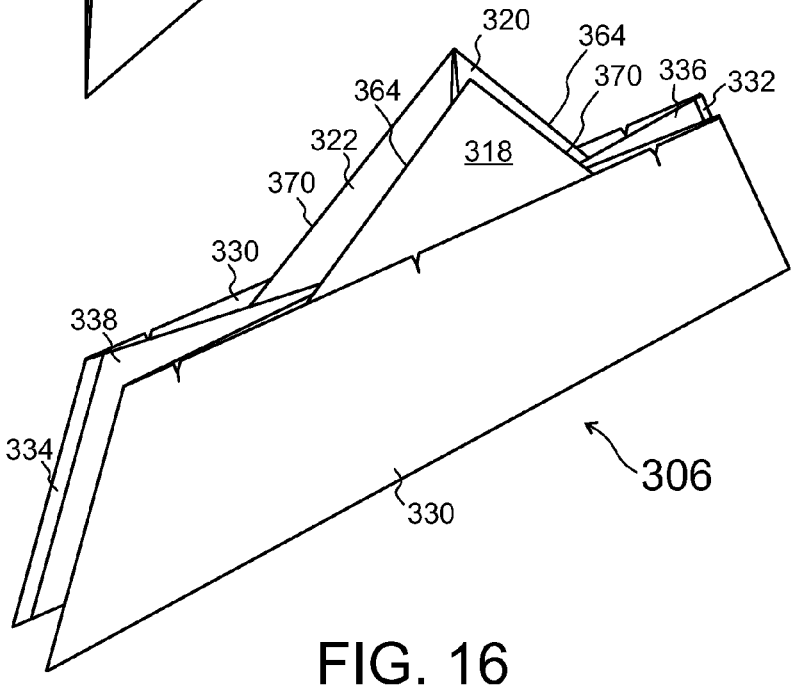
FIG. 16 is a perspective view of the support box 306 shown in FIG. 15 in a near fully folded, closed condition.

In a third alternative embodiment of a support box 306 comprising two flat, die-cut, and pre-scored support box blanks 310, 312, see FIGS. 10 to 16, the support box 306 is formed from two congruent support box blanks 310, 312 as shown in plan form (from an "inside" view) in FIG. 10 that are joined together; each support box blank having a rectangular floor 314; each floor defined respectively by one floor free edge 316 along one edge of the floor and by three floor-to-wall fold lines 348, 356, and 354 along the other three floor edges; each floor respectively having three interconnected floor panels including a full-floor length right isosceles triangular panel 318 having a hypotenuse parallel and opposite to the floor free edge, and the full-floor length right isosceles triangular panel sandwiched between two smaller right isosceles triangular panels 320, 322, each respective leg of the full-floor length right isosceles triangular panel congruent, adjacent, and respectively along one of the hypotenuses of the smaller right isosceles triangular panels to complete the rectangular floor of the support box blank, two adjacent legs from the two smaller right isosceles triangular panels each form half of the floor free edge; an integral endwall 330 depending upwards from and along the length of the hypotenuse of the full-floor length right isosceles triangular panel; two endwall corner overlap tabs 332, 334 with one endwall corner overlap tab at each end of the endwall; two integral half sidewalls 336, 338 with each sidewall respectively depending upwards from and along and extending beyond the length of a leg of the adjacent smaller right isosceles triangular panel; two sidewall corner overlap tabs 340, 342 with respectively one sidewall corner overlap tab adjacent each endwall corner overlap tab; a sidewall hinge line 344 across one of the sidewalls 338 adjacent the floor free edge and perpendicular to the adjacent leg of one of the smaller right isosceles triangular panels; a sidewall hinging overlap 346 extending across and beyond the sidewall hinge line from a main portion of the sidewall; fold lines 348, 354, 356, 360, 362, 364, 370, 372, 374; die cuts 76, 82, 86; a plurality of liner gripping slits 80 distributed along the free edges of the endwalls and the sidewalls (preferably adjacent portions of the flexible liner 4 inserted into the support box are inserted into respective gripping slits to be retained therein by frictional forces whereby the liner is secured and retained within the support box); a plurality of handhold flaps 84 selectively distributed in the sidewalls; a plurality of floor anchor flaps 88 selectively distributed along the floor adjacent the sidewalls; and a plurality of anchor flap apertures 90 in the anchor flaps.

Figure 17:
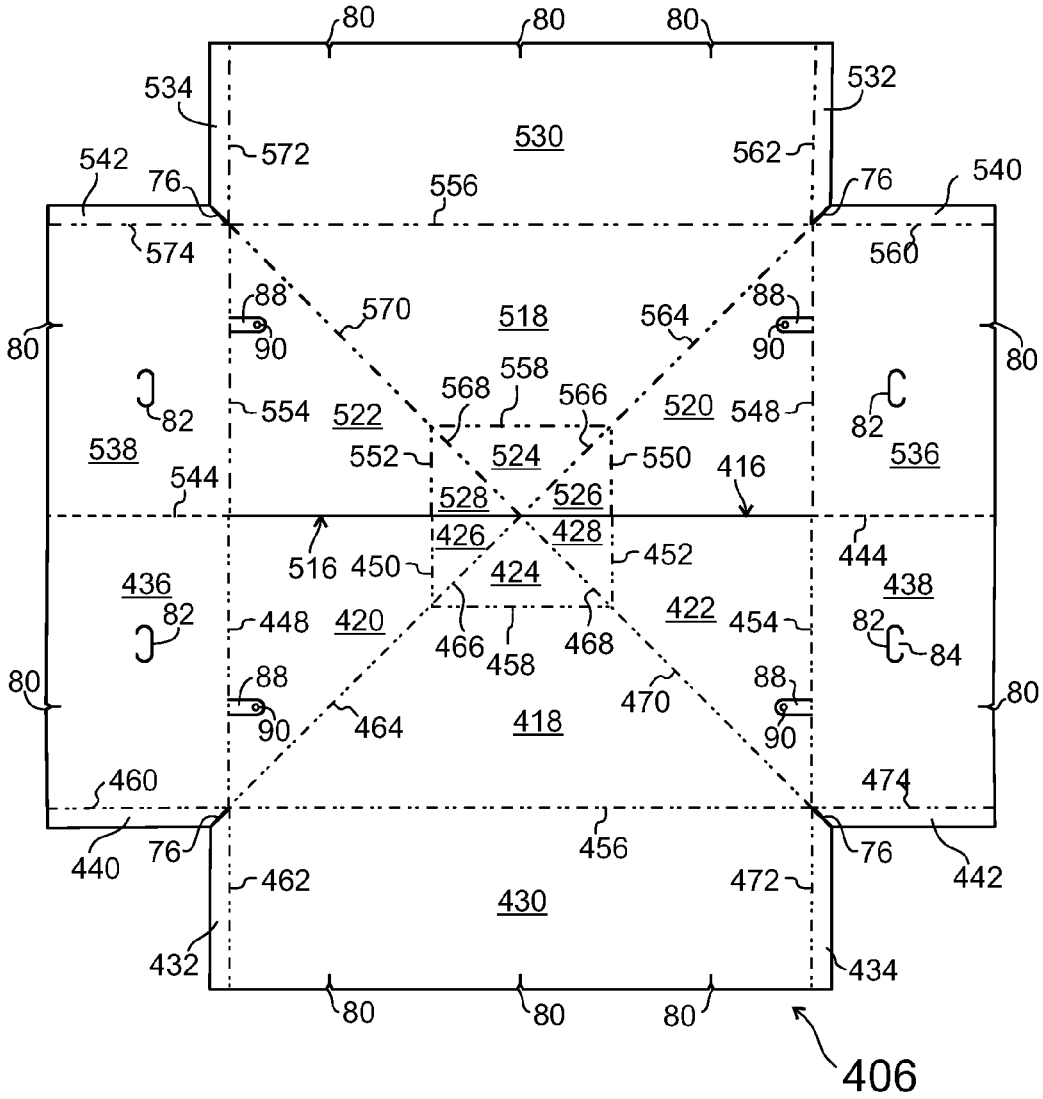
FIG. 17 is a top plan view of a fourth alternative embodiment of an unassembled support box 406 having one flat, die-cut, pre-scored support box blank.

FIG. 17 is a top plan view of a fourth alternative embodiment of an unassembled support box 406 having one flat, die-cut, and pre-scored support box blank. In the alternative embodiment of an unassembled support box 406, the support box 406 is formed from one flat, generally square, die-cut, and pre-scored support box blank as shown in plan form (from an "inside" view) in FIG. 17; the support box blank having two rectangular floors; each floor defined respectively by a floor free edge 416, 516 along one edge of each floor and by three floor-to-wall fold lines 448, 548, 456, 556, and 454, 554 along the other three floor edges; each floor respectively having six interconnected floor panels including a full-floor length isosceles trapezoidal panel 418, 518 having base angles of 45 degrees, two half trapezoidal panels 420, 422 and 520, 522, each half trapezoidal panel having base angles of 45 and 90 degrees with the 45 degree base angle and associated leg of each half trapezoidal panel respectively adjacent to one of the base angles and along the length of one of the legs of the isosceles trapezoidal panel and with the other leg of each half trapezoidal panel associated with the 90 degree base angle being an end portion of the floor free edge, one larger isosceles right triangular panel 424, 524 having a hypotenuse congruent and along the length of a smaller base of the isosceles trapezoidal panel, two congruent smaller isosceles right triangular panels 426, 428 and 526, 528 with each smaller isosceles right triangular panel respectively having a hypotenuse congruent and along the length of one of the legs of the larger isosceles triangular panel and a leg congruent and along the length of a smaller base of one of the half trapezoidal panels and the other leg being one of two intermediate portions of the floor free edge; an integral endwall 430, 530 depending upwards from and along the length of a larger base of the respective isosceles trapezoidal panel; two endwall corner overlap tabs 432, 434 and 532, 534 with one endwall corner overlap tab at each end of the endwall; two integral half sidewalls 436, 438 and 536, 538 with each sidewall respectively depending upwards from and along the length of a larger base of the adjacent half trapezoidal panel; two sidewall corner overlap tabs 440, 442 and 540, 542 with respectively one sidewall corner overlap tab adjacent each endwall corner overlap tab; a sidewall hinge line 444, 544 across one of the sidewalls 438, 538 adjacent each floor free edge and perpendicular to the larger base of the adjacent half trapezoidal panel 422, 522; fold lines 448, 450, 452, 454, 456, 458, 460, 462, 464, 466, 468, 470, 472, 474, 548, 550, 552, 554, 556, 558, 560, 562, 564, 566, 568, 570, 572, 574; die cuts 76, 82, 86; a plurality of liner gripping slits 80 distributed along the free edges of the endwalls and the sidewalls (preferably adjacent portions of the flexible liner 4 inserted into the support box are inserted into respective gripping slits to be retained therein by frictional forces whereby the liner is secured and retained within the support box); a plurality of handhold flaps 84 selectively distributed in the sidewalls; a plurality of floor anchor flaps 88 selectively distributed along the floor adjacent the sidewalls; and a plurality of anchor flap apertures 90 in the anchor flaps.

Figure 18:
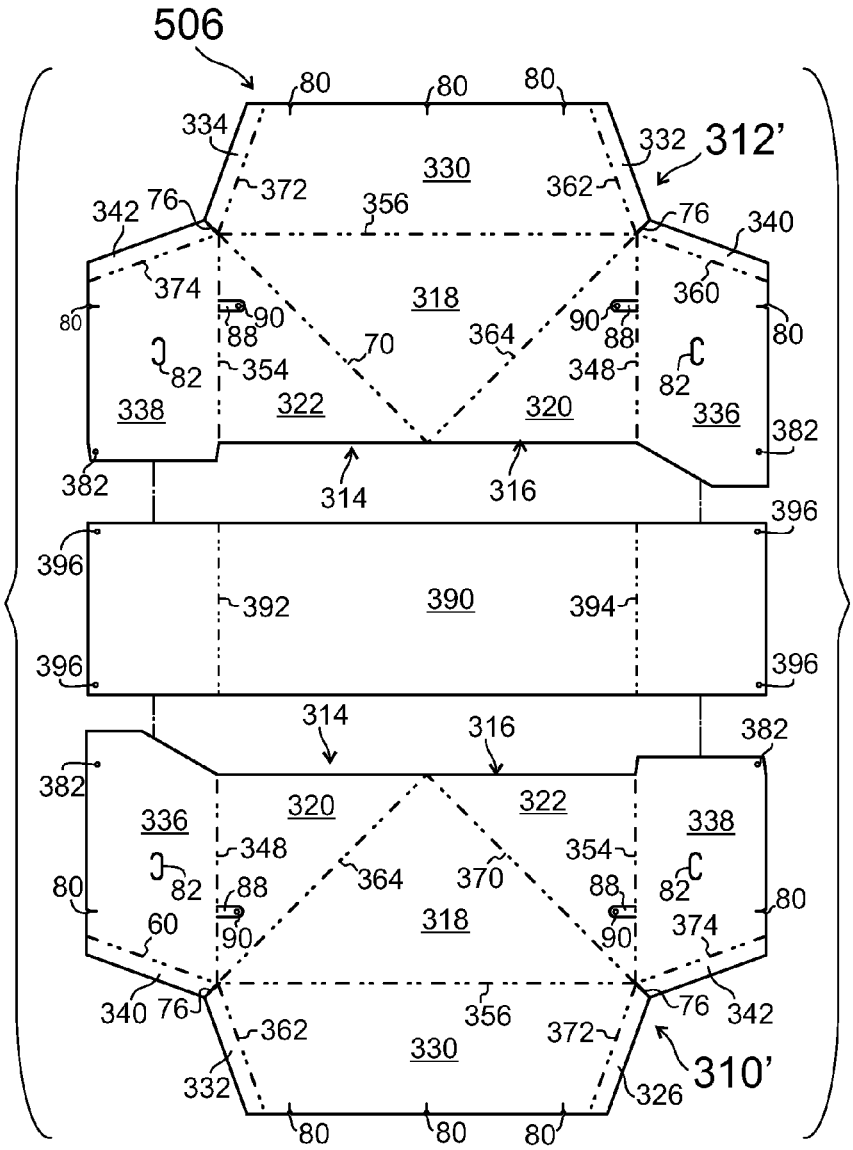
FIG. 18 is an exploded top plan view of a fifth alternative embodiment of a support box 506 having three flat, die-cut, and pre-scored support box blanks 310', 312', 380.
Figure 19:
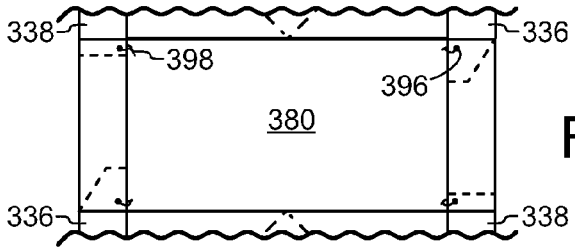
FIG. 19 is an partial top plan view of the support box 506 shown in FIG. 18 partially assembled showing a floor extension panel 380 connected and bridging between blanks 310' and 312'.

In a fifth alternative embodiment of a support box 506 as shown in FIGS. 18 and 19, the blanks 310 and 312 of the third alternative embodiment of a support box 306 are not joined directly to one another and are modified by the addition of at least one cooperating zip tie aperture 382 in each sidewall 336 and 338 near the free edge of each sidewall away from the endwall 330 and away from the floor 314 into modified blanks 310' and 312' and the modified blanks are spaced one from the another by a floor extension panel 390 having two parallel traverse sidewall fold lines 392 and 394 spaced apart the full floor length of blank 310' and having at least four zip tie cooperating apertures 396 with one cooperating aperture in each corner portion of the extension panel to cooperate respectively with one of the zip tie apertures 392 and a commonly known zip tie 398 or another suitable securing device to join the extension panel to and between the blanks 310' and 312'.

Figure 20:
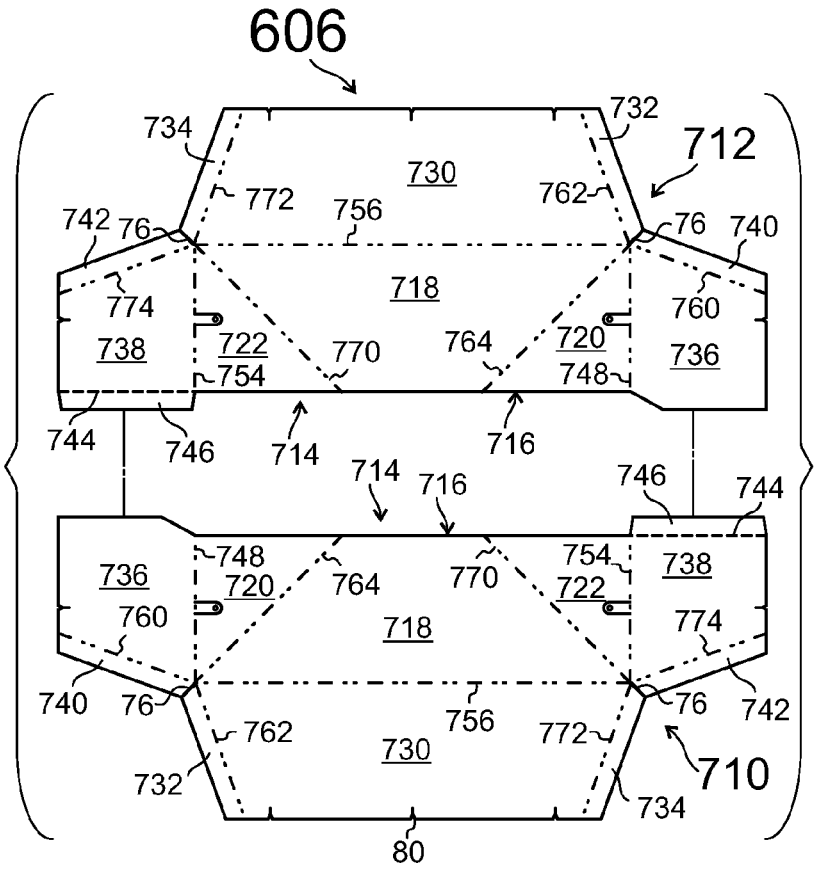
FIG. 20 is an exploded top plan view of a sixth alternative embodiment of a support box 606 having two flat, die-cut, and pre-scored support box blanks 710, 712.

In a sixth alternative embodiment of a support box 606 comprising two flat, die-cut, and pre-scored support box blanks 710, 712. The support box 606 is formed from two congruent support box blanks 710, 712 as shown in plan form (from an "inside" view) in FIG. 20 that are joined together; each support box blank having a rectangular floor 714; the floor defined by a floor free edge 716 along one edge of the floor and by three floor-to-wall fold lines 748, 756, and 754 along the other three floor edges; each floor having three interconnected floor panels including a full-floor length isosceles trapezoidal panel 718 having base angles of 45 degrees and a larger base parallel and opposite to the floor free edge, and the full-floor length isosceles trapezoidal panel sandwiched between two right isosceles triangular panels 720, 722, each respective leg of the full-floor length right isosceles trapezoidal panel congruent, adjacent, and along one of the hypotenuses of the right isosceles triangular panels to complete the rectangular floor of the support box blank, two adjacent legs from the two right isosceles triangular panels form respective and opposite end portions of the floor free edge around a floor free edge middle portion formed by a small base of the trapezoidal panel; an integral endwall 730 depending upwards from and along the length of the large base of the full-floor length isosceles trapezoidal panel; two endwall corner overlap tabs 732, 734 with one endwall corner overlap tab at each end of the endwall; two integral half sidewalls 736, 738 with each sidewall respectively depending upwards from and along and extending beyond the length of a leg of the adjacent smaller right isosceles triangular panel; two sidewall corner overlap tabs 740, 742 with respectively one sidewall corner overlap tab adjacent each endwall corner overlap tab; a sidewall hinge line 744 across one of the sidewalls 738 adjacent the floor free edge and perpendicular to the adjacent leg of one of the right isosceles triangular panels; a sidewall hinging overlap 746 extending across and beyond the hinge line from a main portion of the sidewall; fold lines 748, 750, 752, 754, 756, 758, 760, 762, 764, 766, 768, 770, 772, 774; die cuts 76; a plurality of liner gripping slits 80 distributed along the free edges of the endwalls and the sidewalls (preferably adjacent portions of the flexible liner 4 inserted into the support box are inserted into respective gripping slits to be retained therein by frictional forces whereby the liner is secured and retained within the support box); a plurality of floor anchor flaps selectively distributed along the floor adjacent the sidewalls; and a plurality of anchor flap apertures in the anchor flaps.

Figure 21:
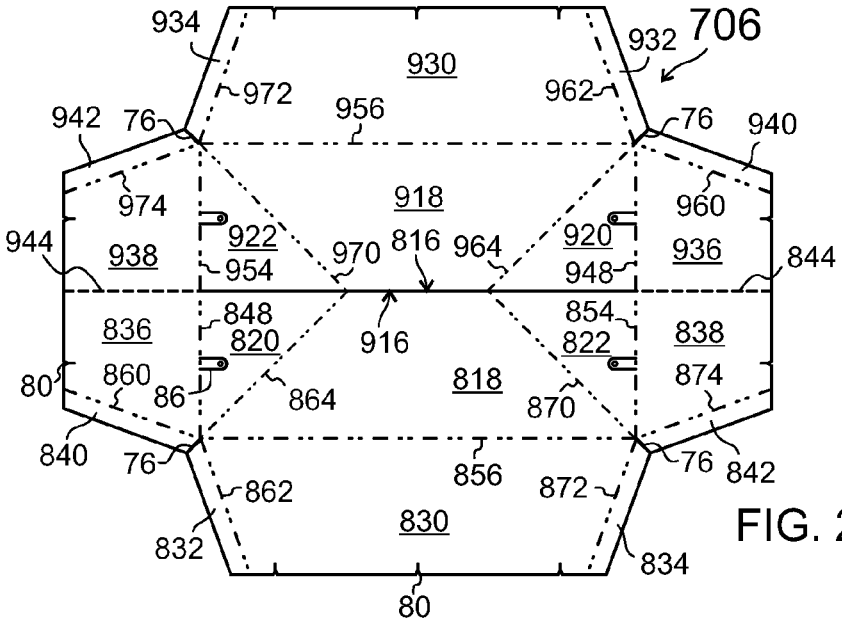
FIG. 21 is a top plan view of a seventh alternative embodiment of an unassembled support box 706 having one flat, die-cut, and pre-scored support box blank.

FIG. 21 is a top plan view of a seventh alternative embodiment of an unassembled support box 706 having one flat, die-cut, and pre-scored support box blank. The support box 706 is formed from a single flat, generally rectangular, die-cut, and pre-scored support box blank as shown in plan form (from an "inside" view) in FIG. 21; the support box blank having two rectangular floors; each floor defined respectively by a floor free edge 816, 916 along one edge of each floor and by three floor-to-wall fold lines 848, 948, 856, 956, and 854, 954 along the other three floor edges; each floor respectively having three interconnected floor panels including a full-floor length isosceles trapezoidal panel 818, 918 having base angles of 45 degrees and a larger base parallel and opposite to the floor free edge, and the full-floor length isosceles trapezoidal panel sandwiched between two right isosceles triangular panels 820, 822 and 920, 922, each respective leg of the full-floor length right isosceles trapezoidal panel congruent, adjacent, and along one of the hypotenuses of the right isosceles triangular panels to complete the respective rectangular floor of the support box blank, two adjacent legs from the two right isosceles triangular panels form respective and opposite end portions of the floor free edge around a floor free edge middle portion formed by a small base of the trapezoidal panel; an integral endwall 830, 930 depending upwards from and along the length of the large base of the respective full-floor length isosceles trapezoidal panel; two endwall corner overlap tabs 832, 834 and 932, 934 with one endwall corner overlap tab at each end of the endwall; two integral half sidewalls 836, 838 and 936, 938 with each sidewall respectively depending upwards from and along the length of a leg of the adjacent smaller right isosceles triangular panel; two sidewall corner overlap tabs 840, 842 and 940, 942 with respectively one sidewall corner overlap tab adjacent each endwall corner overlap tab; a sidewall hinge line 844, 944 across one of the sidewalls 838, 938 adjacent each floor free edge and perpendicular to the adjacent leg of one of the right isosceles triangular panels; fold lines 848, 854, 856, 860, 862, 864, 870, 872, 874, 948, 954, 956, 960, 962, 964, 970, 972, 974; die cuts 76, 86; a plurality of liner gripping slits 80 distributed along the free edges of the endwalls and the sidewalls (preferably adjacent portions of the flexible liner 4 inserted into the support box are inserted into respective gripping slits to be retained therein by frictional forces whereby the liner is secured and retained within the support box); a plurality of floor anchor flaps selectively distributed along the floor adjacent the sidewalls; and a plurality of anchor flap apertures in the anchor flaps.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

We claim:

1. A foldable concrete washout and waste containment unit comprising:

two congruent support box blanks operatively and foldably connected one to the other; each said support box blank comprising:

a rectangular floor having a first large right isosceles triangular floor panel foldably connected respectively along each leg to a second small right isosceles triangular floor panel and to a third small right isosceles triangular floor panel, each said small right isosceles triangular floor panel congruent to the other, an integral endwall foldably connected and depending from and along the hypotenuse of the first large right isosceles triangular floor panel, two integral half sidewalls each said half sidewall foldably connected and depending from and along the length of a leg of an adjacent said small right isosceles triangular floor panel and each said half sidewall adjacent and foldably connected to respective opposite ends of said endwall, said rectangular floor having a floor free edge opposite said endwall;

said two support box blanks foldably connected one to the other by foldably connecting said half sidewalls at opposite ends of said floor free edge of one said support box blank to respective said half sidewalls at opposite ends of said floor free edge of the other said support box blank; and a flexible liner received within and extending out from within said support box.

2. The foldable concrete washout and waste containment unit in accordance with claim 1 wherein the rectangular floor panel includes a first large right isosceles triangular floor panel fold line parallel to each said endwall and across each said first large right isosceles triangular floor panel, and a small right isosceles triangular floor panel fold line parallel to each said half sidewall and across each said small right isosceles triangular floor panel and intersecting said first large right isosceles triangular floor panel fold line of the respective adjacent said large right isosceles triangular floor panel.

* * * * *